US005317885A

United States Patent [19]

Vignoni

[11] Patent Number: 5,317,885

[45] Date of Patent: Jun. 7, 1994

[54] WINDING DEVICE FOR SPLIT KNITTED FABRIC

[75] Inventor: Cesare Vignoni, Brescia, Italy

[73] Assignee: Vignoni S.r.l., Bergamo, Italy

[21] Appl. No.: 949,787

[22] Filed: Sep. 22, 1992

[30] Foreign Application Priority Data

Sep. 23, 1991 [IT] Italy ..... BS/91/A/000101

[51] Int. Cl.[5] ..... D04B 15/88

[52] U.S. Cl. ..... 66/151; 83/102; 83/872; 242/56.4; 66/149 R; 66/153

[58] Field of Search ..... 66/147, 150, 151, 152, 66/149 R; 242/56.4, 56.5; 83/872, 102

[56] References Cited

U.S. PATENT DOCUMENTS

| | | | |
|---|---|---|---|
| 2,092,966 | 9/1937 | Gay et al. | 242/56.4 |
| 2,789,423 | 4/1957 | Václavík | 66/149 R |
| 3,572,060 | 3/1971 | Titone | 66/152 X |
| 3,581,344 | 6/1971 | Sederlund et al. | 66/147 X |
| 3,855,822 | 12/1974 | Lee | 66/151 X |
| 3,921,418 | 11/1975 | Apken | 66/147 X |
| 4,233,825 | 11/1980 | Glaspie | 66/152 X |
| 4,807,541 | 2/1989 | Goller et al. | 66/149 R |
| 4,830,302 | 5/1989 | Hawkins | 242/56.4 X |
| 4,932,599 | 6/1990 | Doerfel | 242/56.4 |

*Primary Examiner*—Clifford D. Crowder
*Assistant Examiner*—John J. Calvert
*Attorney, Agent, or Firm*—McGlew and Tuttle

[57] ABSTRACT

The present invention pertains to a circular knitting machine with a pair of cutting devices (15) in opposite positions for longitudinally cutting, on two sides, the tubular fabric component and for forming two individual even pieces (13*a*, 13*b*) and with two winding units (11, 12) for separately winding the two pieces onto rolls, the pieces being led in opposite directions by central return rollers (16, 17).

11 Claims, 2 Drawing Sheets

10
11
12
13
13a
13b
14
14a
15
16
17
18
19
20
21
21a
22
22a
23
24
25

WINDING DEVICE FOR SPLIT KNITTED FABRIC

FIELD OF THE INVENTION

The present invention concerns the field of circular knitting machines and specifically pertains to a winding unit for the winding on a roll of the fabric produced on such machines.

BACKGROUND OF THE INVENTION

From the knitting process oil circular machines there is obtained, as is known, a fabric component having a tubular shape which is led and progressively wound onto a winding roller arranged in the lower part of tlie machine. However, it is well known to persons skilled in the art that with the winding onto the winding roller of the tubular fabric, two folds are inevitably formed along two generators on opposite sides of the tubular component and produce an opposite effect during treatments, processing and subsequent use of tile fabric. Even when the tubular fabric component is being cut along its generator, the problem is only partially resolved since, with the winding of the fabric component onto a winding roller, even if open on one side, a longitudinal fold is always formed, however, on the other side of the fabric.

SUMMARY AND OBJECTS OF THE INVENTION

On the contrary, the object of the present invention is to solve such a problem in a new and original manner with the unquestionable advantage of eliminating the formation folds on the fabric due to winding in such a way as to provide even pieces or lengths of fabric capable of being used more easily and comfortably.

The solution to the problem is achieved by longitudinally cutting, on two opposite parts, the tubular fabric component as produced on a circular knitting machine, so as to form two individual even pieces, and by winding the pieces or lengths of fabric on two separate winding units.

Therefore, the circular machine is provided, not with only one winding unit as usual, but with two piece-winding units which are arranged in parallel and with two cutting devices in opposite positions. The two piece-winding units are operated contemporaneously by a single control drive for rotating in opposite directions and winding the two pieces, the one in the opposite direction of the other. Thus, the surface of the knitted fabric which is facing the inside of the starting component is turned towards the center of the roll which is formed on each winding unit.

Since the edges of each piece produced from the longitudinal cuts of the tubular component have the tendency to be rolled up or curled up, each winding unit also comprises a stretching roller intended for stretching out or drawing the edges and smoothing out the piece for its correct winding. The stretching roller is arranged in parallel to the corresponding winding roller and is operated by a control drive derived from that which operates the winding roller.

It must be noted that tile adoption of two piece-winding units on a circular knitting machine does not change in any way, however, the structure and the operation of the machine. In other words, the machine can be equipped either in the traditional manner with only one winding unit or with two winding units in accordance with the present invention.

Each piece wound on the winding rollers shall have a width equal to half the circumference of the starting tubular component. In order to obtain pieces of suitable width, at least equal to that of a piece produced by the opening of a cut tubular component, as usual, along only one generator, it is possible start with a machine having a greater diameter, that is, double. This is not a disadvantage since from such a machine are produced two pieces having a width equal to the generation of a tubular component produced on a very small machine, especially already cut and advantageously without folds.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
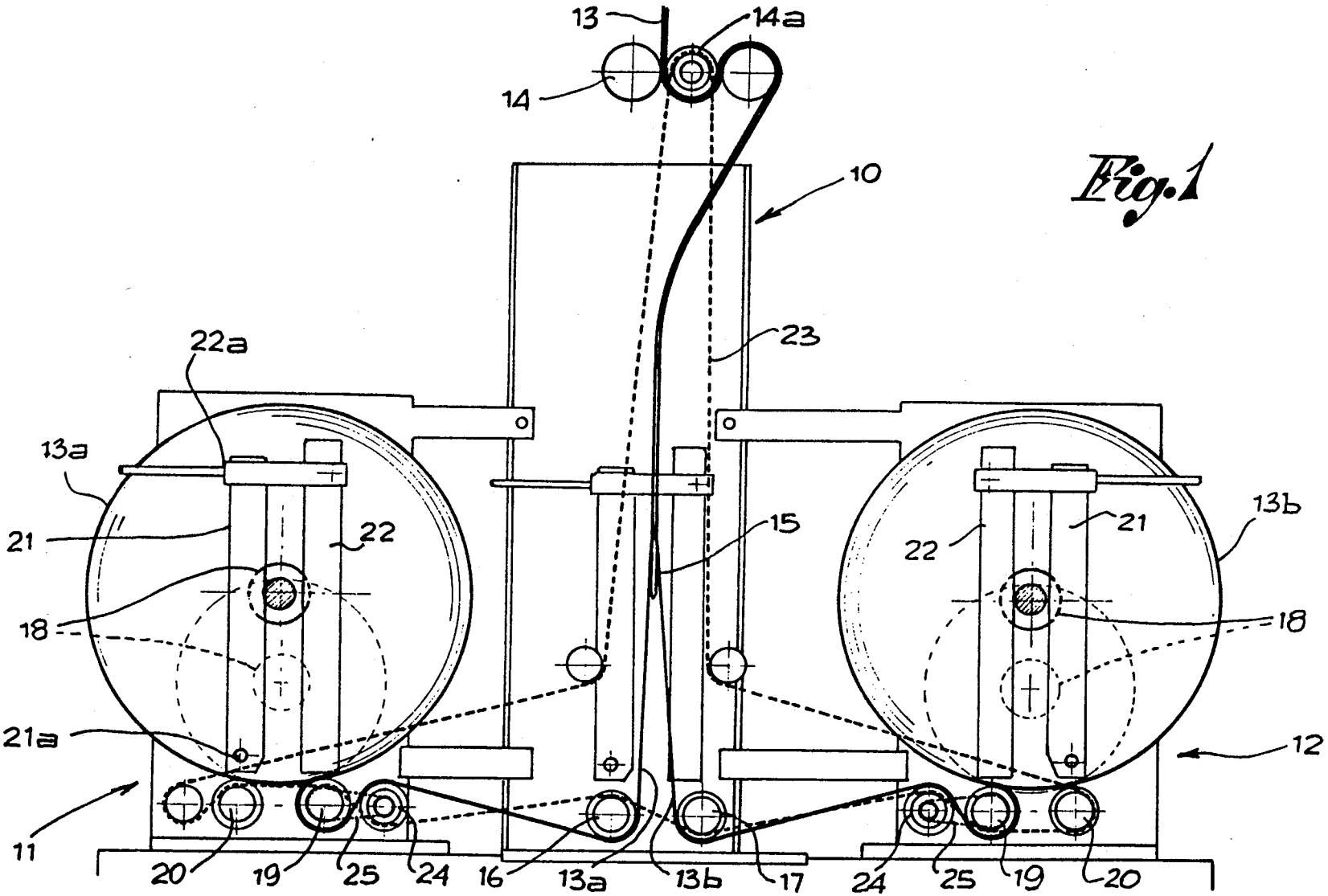
FIG. 1 shows schematically the two winding units and pertinent controls.

In the drawings, part of the base of a circular knitting machine is indicated as 10, and the two winding units, which are arranged symmetrically and applied on opposite sides of the base, are indicated as 11 and 12.

The knitted tubular component 13 produced on the circular machine or knitting means is set into motion by means of guide or transport rollers 14, one of which **14*a* is operated by a drive (not shown) derived from that which operates the cylinder of the machine. The tubular component 13 is cut longitudinally on opposite sides by means of cutters 15, provided with a sharpener. The cutters 15 are located at the base of the machine under the guide rollers 14 and in a position centered between the two winding units. After cutting, the tubular component 13 is divided into two pieces or lengths of fabric 13*a*, 13*b* which are guided and directed in opposite directions, by means of central return rollers 16, 17, to the winding units 11, 12**, respectively.

Figure 2:
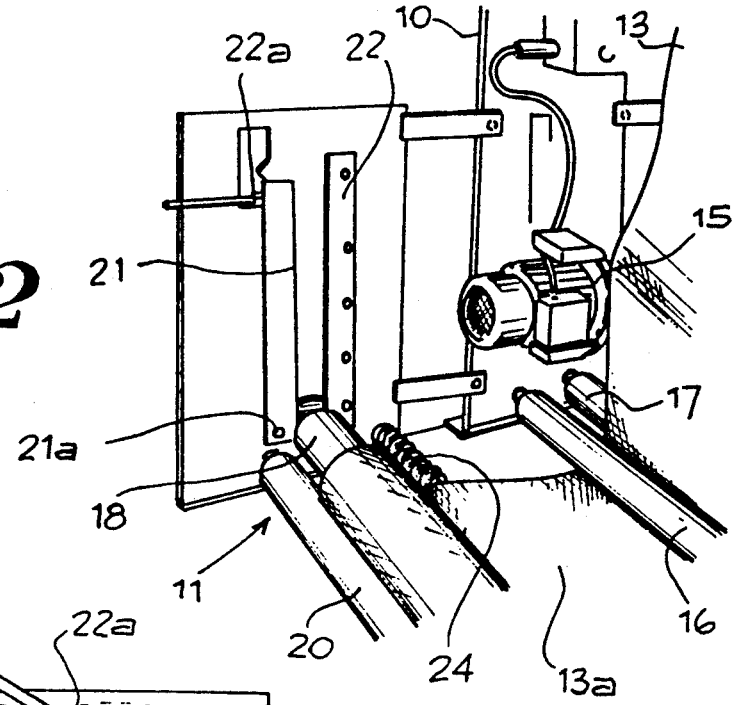
FIG. 2 shows in perspective view part of one of the winding units with guides for the winding roller.
Figure 4:
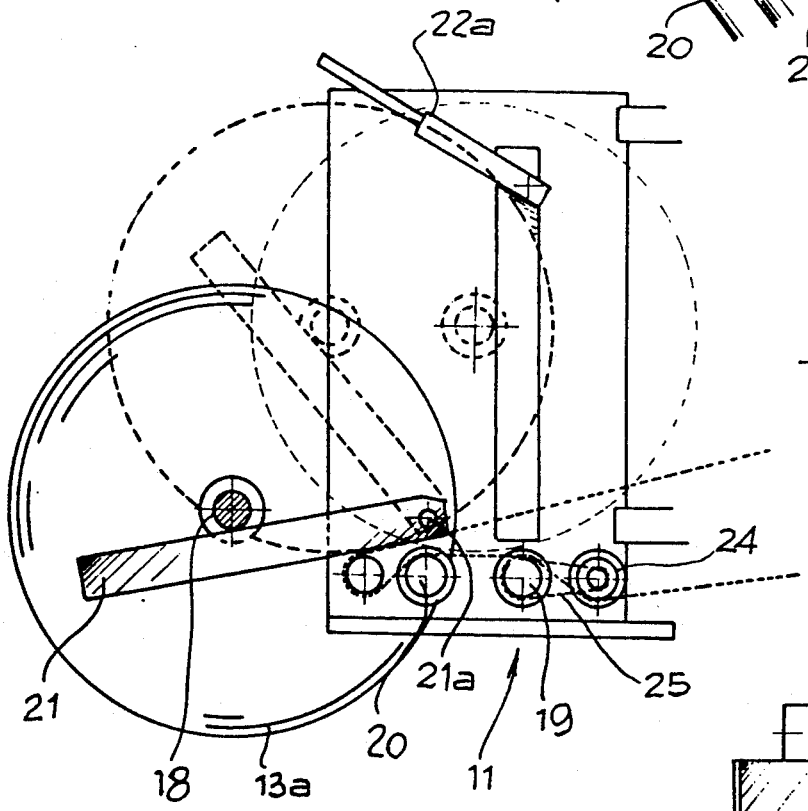
FIG. 4 shows schematically the arrangement for the unloading of a roll of fabric from the machine.

Each winding unit 11, 12 comprises a winding roller 18 controlled in rotation, with friction, by a pair of guiding rollers 19, 20. As shown in FIG. 1, the winding roller 18 rests, due to gravity, on the complanate guiding rollers 19, 20 across the wound-up piece. Moreover, the winding roller 18 has end necks—cf. FIGS. 2 and 4—each arranged between two vertical outer and inner guide gibs 21, 22 which make it possible to raise the roller for increasing the diameter of tile piece roll which is being wound up.

The guiding rollers 19, 20 of both winding units 11, 12, as well as the central return rollers 16, 17, are operated simultaneously by a control drive 23, for example, a chain drive, which leads to the movement of the above-mentioned roller 14a. The drive 23 is such that it rotates the winding rollers 18 in opposite directions so as to wind the pieces or lengths of fabric 13a, 13b in opposite directions and with the inside surface of the pieces, or lengths of fabric, coming from the machine being turned towards, or wound on, the center of the roll.

On the inlet side in each winding unit of pieces 13a and 13b, a stretching roller 24, of the type with two opposite screws or screw surfaces, is coupled in parallel to the winding roller 18 for stretching out and drawing the edges of the piece which tend to be rolled up immediately before the piece 13a or 13b is wound onto the roller 18. The stretching roller 24 is operated in rotation by a drive 25, for example, a chain drive, controlled by the adjacent guiding roller 19 with an appropriate ratio. Basically therefore, the knitting tubular component 13 is longitudinally cut on two sides so as to form two pieces 13a, 13b. The two pieces are led separately and wound progressively onto two winding rollers 18 after being passed onto the stretching roller 24.

The vertical guide gib 21, at the neck of each winding roller is arranged towards the outside of the machine. This gib 21 is pivoted toward the bottom at 21a and blocked in the vertical position by means of a releasable means 22a. Because of this, the gibs 21 can be released and folded on one side—cf. FIG. 4—to form an inclined plane which aids the unloading of the fabric roll once completed.

Figure 3:
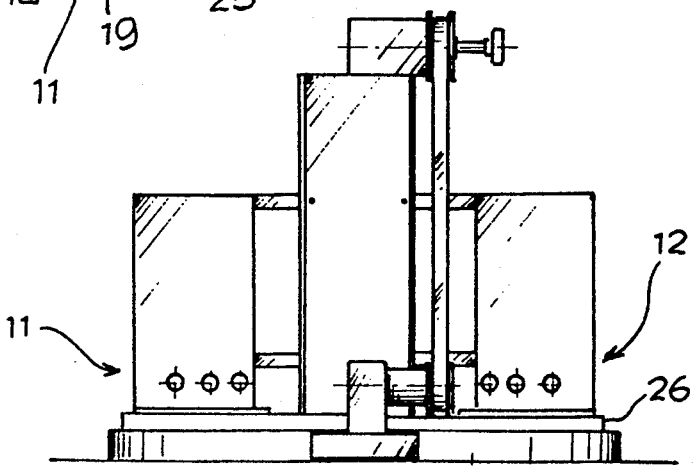
FIG. 3 shows a lateral view of the units applied to the base of a circular machine.

If, as usually occurs, the unloading of the fabric on the roll is provided on only one side of the machine, the winding units can be mounted oil a rotating platform 26—cf. FIG. 3. This allows the machine to be able to support one roll after the other in correspondence to the only unloading outlet and emptying the machine by making use of the inclined planes which are produced by folding the guide gibs 21.

While specific embodiments of the invention have been shown and described in detail to illustrate the application of the principles of the invention, it will be understood that the invention may be embodied otherwise without departing from such principles.

I claim:

1. A circular knitting and winding apparatus comprising:

knitting means for producing a tubular fabric;

transport roller means for transporting said tubular fabric away from said knitting means;

cutting means positioned downstream of said transport roller means and for cutting said tubular fabric into first and second separate fabric pieces;

first central roller means for leading said first fabric piece in a first direction;

second central roller means for leading said second fabric piece in a second direction, said second direction being substantially opposite said first direction;

first winding means for winding said first fabric piece after said first fabric has passed said first central roller means;

second winding means for winding said second fabric piece after said second fabric has passed said second central roller means;

a single unloading outlet positioned adjacent one of said first and second winding means; and a rotating platform means supporting said first and second winding means and for rotating said first and second winding means into a position adjacent said unloading outlet.

2. An apparatus in accordance with claim 1, wherein:

said cutting means includes two cutters cutting said tubular fabric in a cutting plane substantially parallel to said transporting of said tubular fabric; and said first and second winding means being positioned on opposite sides of said cutting plane.

3. An apparatus in accordance with claim 1, wherein:

each of said first and second winding means includes inner and outer gib means for guiding said winding roller as said winding roller increase an external diameter due to said winding of a respective fabric piece on a respective winding roller, said each of said first and second winding means also including pivot means for pivoting said outer gib at one end for forming an inclined plane for unloading of said winding roller from said inner and outer gib.

4. An apparatus in accordance with claim 1, wherein said first and second central roller means and said guiding rollers of said first and second winding means guide said first and second fabric pieces to cause an inside surface of said tubular fabric to be directed radially inward during said winding of said first and second fabric pieces on respective winding rollers.

5. An apparatus in accordance with claim 1, wherein:

said cutting means cuts said tubular fabric into substantially equal sized first and second fabric pieces.

6. An apparatus in accordance with claim 1, wherein:

said transport roller means is positioned downstream of said knitting means and includes rollers contacting said tubular fabric.

7. An apparatus in accordance with claim 1, further comprising:

a base supporting said first and second winding means, said first and second winding means being positioned on opposite sides of said base, said cutting means being positioned between said first and second winding means, said transport roller means being positioned above said base.

8. A circular knitting and winding apparatus comprising:

knitting means for producing a tubular fabric;

transport roller means for transporting said tubular fabric away from said knitting means;

cutting means positioned downstream of said transport roller means and for cutting said tubular fabric into first and second separate fabric pieces;

first central roller means for leading said first fabric piece in a first direction;

second central roller means for leading said second fabric piece in a second direction, said second direction being substantially opposite said first direction;

first winding means for winding said first fabric piece after said first fabric has passed said first central roller means, said first winding means includes a winding roller and inner and outer gib means for guiding said winding roller as said winding roller increases an external diameter due to said winding of a respective fabric piece on a respective winding roller, said first winding means also including pivot means for pivoting said outer gib means at one end for forming an inclined plane for unloading of said winding roller from said inner and outer gib means; and second winding means for winding said second fabric piece after said second fabric has passed said second central roller means, said second winding means includes a winding roller and inner and outer gib means for guiding said winding roller as said winding roller increases an external diameter due to said winding of a respective fabric piece on a respective winding roller, said second winding means also including pivot means for pivoting sad outer gib means at one end for forming an inclined plane for unloading of said winding roller from said inner and outer gib means.

9. An apparatus in accordance with claim 8, wherein:

each of said first and second winding means includes releasable means for holding said outer gib means in a substantially vertical position and for releasing said gib into said inclined plane.

10. A circular knitting and winding apparatus comprising:

knitting means for producing a tubular fabric;

transport roller means for transporting said tubular fabric away from said knitting means;

cutting means positioned downstream of said transport roller means and for cutting said tubular fabric into first and second separate fabric pieces;

first central roller means for leading said first fabric piece in a first direction;

second central roller means for leading said second fabric piece in a second direction, said second direction being substantially opposite said first direction;

first winding means for winding said first fabric piece after said first fabric has passed said first central roller means, said first winding means including a pair of substantially complanate guiding rollers and a winding roller, said pair of guiding rollers supporting said winding roller, and said pair of guiding rollers rotating said winding roller by frictional contact of said guiding rollers, through a respective fabric piece and against said winding roller, said first winding means also including stretch roller means for stretching out edges of said respective fabric piece before said respective fabric piece is wound onto a respective winding unit, said stretch roller means including two substantially opposite screws and being driven by one of said guiding rollers, said stretching means also being rotated faster than said one of said guiding rollers; and second winding means for winding said second fabric piece after said second fabric has passed said second central roller means, said second winding means including a pair of substantially complanate guiding rollers and a winding roller, said pair of guiding rollers supporting said winding roller, and said pair of guiding rollers rotating said winding roller by frictional contact of said guiding rollers, through a respective fabric piece and against said winding roller, said second winding means also including stretch roller means for stretching out edges of said respective fabric piece before said respective fabric piece is wound onto a respective winding unit, said stretch roller means including two substantially opposite screws and being driven by one of said guiding rollers, said stretching means also being rotated faster than said one of said guiding rollers.

11. An apparatus in accordance with claim 10, further comprising:

control drive means connecting said transporting roller means to said first and second central roller means and said guide rollers of said first and second winding means, said transporting roller means operating said first and second central roller means and said guide rollers of said first and second winding means through said control drive means.

* * * * *